United States Patent [19]

Cote et al.

[11] Patent Number: 4,471,713

[45] Date of Patent: Sep. 18, 1984

[54] FLOOR TREATING APPARATUS

[75] Inventors: Kenneth J. Cote, 4506 West Lloyd St., Milwaukee, Wis. 53208; John W. Dickerson, Brookfield, Wis.

[73] Assignee: Kenneth J. Cote, Milwaukee, Wis.

[21] Appl. No.: 477,113

[22] Filed: Mar. 21, 1983

[51] Int. Cl.[3] ..... B05B 9/06; B05C 5/00

[52] U.S. Cl. ..... 118/108; 118/305; 118/207; 118/109; 15/98; 222/614; 222/616; 222/621; 401/15; 401/48; 401/139

[58] Field of Search ..... 118/207, 305, 108, 109, 118/678, 681; 15/49, 50, 98; 239/120, 121, 122; 401/15, 29, 32, 48, 130, 131, 139, 263, 270, 274, 286; 222/613, 614, 615, 616, 617, 621

[56] References Cited

U.S. PATENT DOCUMENTS

| | | | |
|---|---|---|---|
| 1,560,445 | 11/1925 | Wagner | 401/48 |
| 2,547,223 | 4/1951 | Lombardo | 401/15 |
| 3,601,314 | 8/1971 | Hurt | 222/621 |
| 3,899,106 | 8/1975 | Dorval | 222/614 |

*Primary Examiner*—Norman Morgenstern
*Assistant Examiner*—Robert J. Steinberger, Jr.
*Attorney, Agent, or Firm*—Fuller, House & Hohenfeldt

[57] ABSTRACT

Floor treating apparatus, principally for waxing floors includes a drip pan to catch wax from the applicator pad when the applicator head is in a retracted position. A piston pump has an adjustable variable stroke to provide selection of the quantity of wax to be deposited. Slotted connections between the applicator head and the supporting arms provide independent vertical movement of each end of the applicator pad to enable the pad to conform to uneven floors.

7 Claims, 9 Drawing Figures

FLOOR TREATING APPARATUS

BACKGROUND OF THE INVENTION

The invention relates to wax applicators for floors which is a principal intended use of the instant invention. However, it can be employed for applying other liquids than waxes for treatment of floors or planar surfaces. Prior art devices employ gravity fed applicators and have difficulty in providing uniform application of the wax.

SUMMARY OF THE INVENTION

The invention provides a fluid applicator for a floor in which the fluid is provided by pumping pressure rather than by gravity flow and in which the pumping volume is controlled by changing the travel of the piston in the pump with a manually operable lever. A one-way clutch enables movement of the appliance in one direction without any action of the pump and provides pumping activity when the applicator is trailed behind the operator for applying the floor treatment fluid. The positive and variably controlled pump output enables even distribution of the selected amount of wax to eliminate the problems with the prior art wax applicators.

The liquid, such as wax, is applied through orifices in an applicator tube which is contained within a drip pan which is pivotally mounted to the applicator frame. An applicator head with a wax applicator pad is pivotally connected to the drip pan and both are movable between an operative fluid applying position and a retracted storage position by a lever manually accessible by the operator during use. In the retracted position, the drip pan, which is upwardly open and below the applicator tube, is positioned to catch dripping of the wax or floor treatment fluid from the tube. The drip pan is also below the applicator pad to catch the dripping wax from the pad. This prevents inadvertent discharge of fluid onto floor areas which the operator does not wish to treat. Further features of the invention include a quick release applicator head connected with spring-loaded pins which facilitate changing the applicator pad, the wheels and casters provide convenient maneuverability.

Further objects, advantages and features of the invention will become apparent from the disclosure.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figures 1, 2:
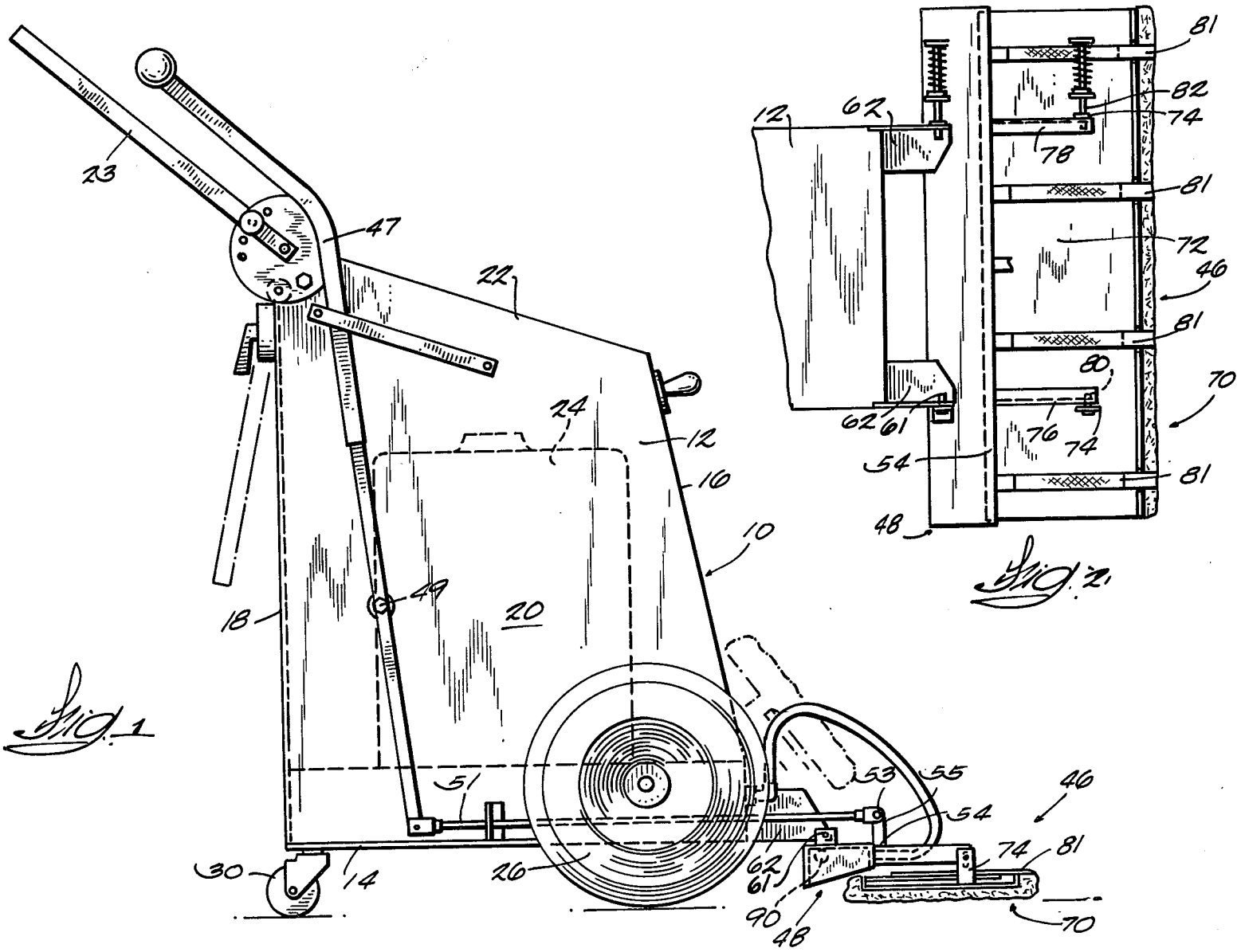
FIG. 1 is a side elevational view of a wax applicator in accordance with the invention.
FIG. 2 is a fragmentary plan view of the applicator shown in FIG. 1.

In the drawings, FIG. 1 shows a fluid or wax floor applicator generally designated 10 which includes a body or frame or housing 12 which has a bottom 14, front wall 16, rear wall 18 and spaced side walls 20 which define an open-topped enclosure with an interior cavity 22 suitable for receiving a receptacle containing the liquid to be applied. A receptacle 24 can be contained in the interior 22 and an adjustable handle 23 can be provided.

The housing 12 is supported by a pair of spaced wheels 26 and 28 and casters 30.

Figure 3:
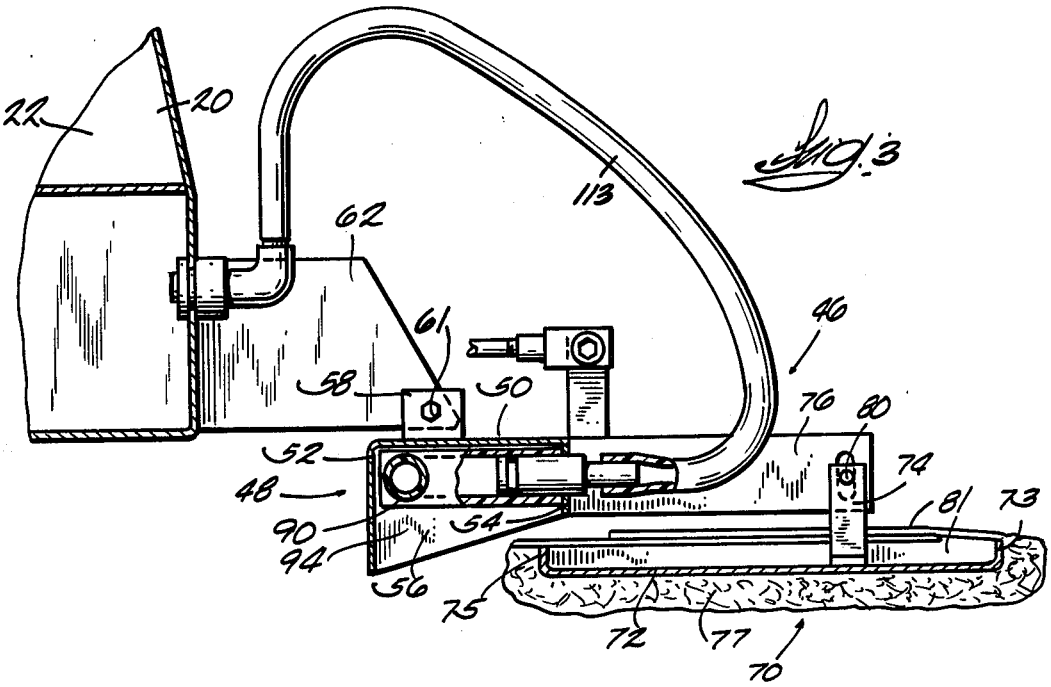
FIG. 3 is a fragmentary enlarged side elevational view in partial section of the spreader head shown in FIG. 1.

Wax or treatment fluid is applied by an applicator assembly 46 which includes (FIG. 3) a trough or drip pan 48 which is formed by a wall 50, a side wall 52, a forward wall 54 and two spaced side walls 56.

Means are provided for pivotally connecting the drip pan and applicator assembly to the frame 12. In the disclosed construction, the means includes two upstanding ears 58 on a wall 50 which are pivotally connected by pins 61 to two brackets 62 (FIG. 2) which extend forwardly from the frame.

The wax applicator 70 includes a plate 72 with two upstanding ears 74 which are pivotally connected to forwardly extending arms 76 and 78 which are welded to the wall 54 of the drip pan 48. A pin 80 and spring-loaded plunger 82 enables quick release of the applicator head 70 from the arms 76 and 78. The plate 72 has upturned side portions 73, 75 (FIG. 3) which assist in supporting the pad 77 which can be fastened by mating Valcro straps 81. The flange 75 also is positioned so that when the drip pan and assembly 46 is in the FIG. 4 retracted position the flange will be located above the pan 4 so that any fluids will drip from the flange 75 into the interior of the trough 48. Slots in the arms 76 and 78 enable independent positioning of the pad 77 and plate 72 to allow the pad 77 to move independently of the arms 76, 78. This allows the pad 77 to conform to the floor surfaces with uneven floors. The plate 72 is mounted off center by ears 74 to gravity bias the leading edge of the pad to insure that it is firmly held against the floor.

The wax applicator plumbing system includes the applicator or wax discharge tube 90 which is supported within the drip pan or trough 48 and has a plurality of longitudinally arranged apertures 91 from which the wax is discharged along the length of the drip pan. The apertures are small to maintain a pressure build-up in the tube for uniform dispersion. Discharge of the wax is represented by arrows 94 in FIGS. 5 and 3. Inasmuch as the pad 77 trails the applicator tube 90 in use, the pad smooths out and applies the wax to the floor as it passes the zones on the floor on which the wax has been discharged.

Figure 5:
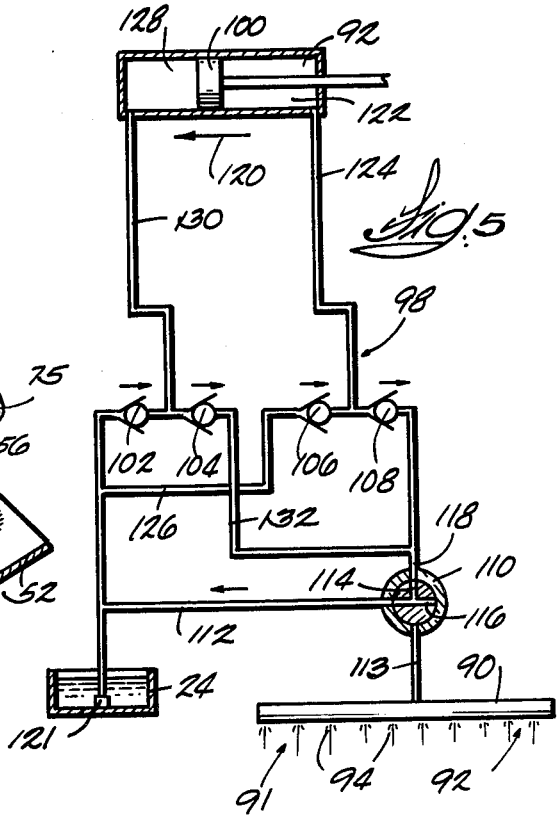
FIG. 5 is a schematic view of the reservoir and pumping circuit.

Referring to FIG. 5, the wax applicator communicates with a pump 92 and a wax reservoir 24 through a plumbing circuit 98. Conduits and check valves are provided so that the piston 100 in the pump 92 is doubleacting and pumps wax on both strokes. Check valves 102, 104, 106 and 108 are employed to accommodate double stroke pumping. A three-way valve 110 controls operation of the pump. With the valve 110 in the position shown in FIG. 5, no wax would be delivered to the applicator tube 90, but the valve would recycle wax by conduit 112 to the reservoir 24. Thus the applicator can be moved without dispensing wax.

With the valve passage 114 blocked and with passage 113 and passage 116 in communication with conduit 118, wax would be delivered to the applicator tube 90. With the piston travelling in the direction of arrow 120, wax will be drawn into the pumping chamber 122 through conduit 124 and branch conduit 126. Wax will be expelled from pumping chamber 128 through conduit 130 and through check valve 104 and branch conduit 132 to the valve 110 and thence to the applicator tube 90. When the piston is moving in the direction opposite the arrow 120, wax is expelled from the pumping chamber 122 through the conduit 124 to the valve 110. During this action, wax is drawn in through conduit 130 to the pumping chamber 128.

Figure 6:
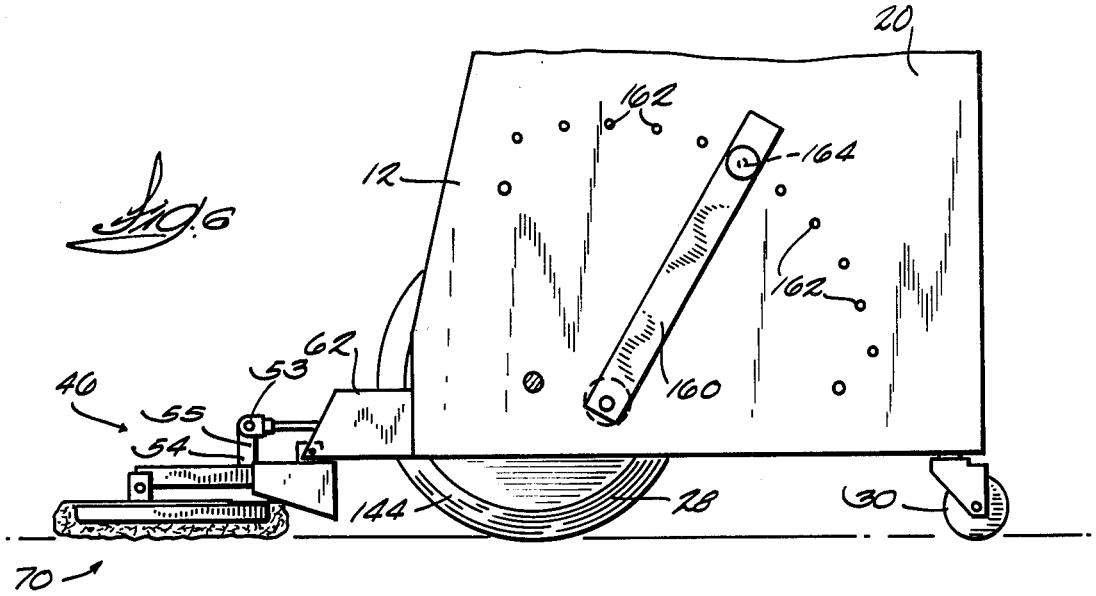
FIG. 6 is a fragmentary side elevational view showing the pump adjustment lever.
Figure 8:
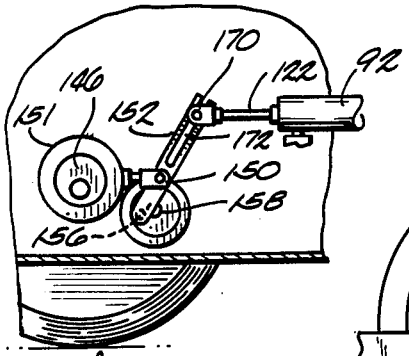
FIG. 8 is a fragmentary view similar to FIG. 7 showing the pump linkage in a different condition.
Figure 7:
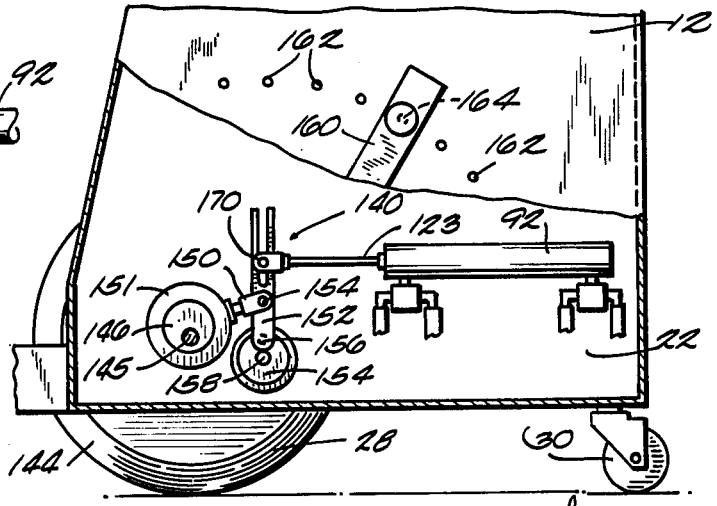
FIG. 7 is a view similar to FIG. 6 with parts broken away to show the pump and pump drive linkage.
Figure 9:
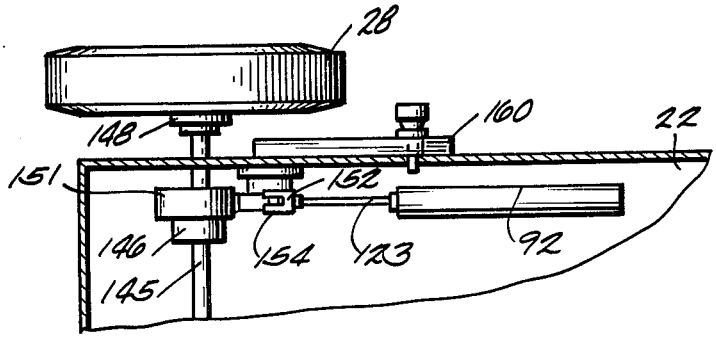
FIG. 9 is a fragmentary plan view of the pump and drive linkage.

The pump 92 is operated by a linkage 140 (FIG. 7) which includes means for adjusting the throw of a link to vary the travel of the piston 100 and hence the pump output. The drive wheel 144 is connected to the axle 145 through a one-way clutch 148. The axle drives an eccentric 146. A first link or follower link 150 having a ring 151 concentric with eccentric 146 is pivotally connected to a second link 152 by a pivot 154. The link 152 is pivotally connected to a hub 154 at a point 156 offset from the axis 158 of the hub. The position of the pivot point 156 relative to the pivot 158 is changeable with an arm 160 (FIGS. 6 and 9) which can be moved to any one of a plurality of selected openings 162 spaced along the wall 20 of the housing. A spring-loaded plunger 164 is selectively registrable in the apertures 162. When the pivot 156 is in the FIG. 8 position, the link 152 swings in a greater arc and there is more travel of the pin 170 in the slotted connection 172 in link 152. The greater motion of the pin 170 causes greater travel and a longer stroke of the piston rod 123 and hence causes discharge of a larger volume of wax from the pump 92.

Figure 4:
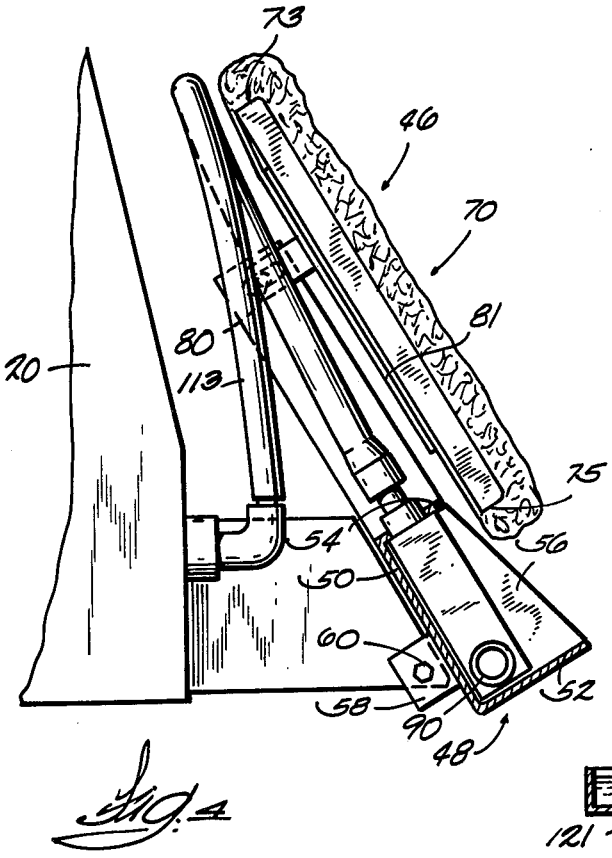
FIG. 4 is a view similar to FIG. 3 with a drip trough and applicator pad in the retracted position.

The drip pan and applicator assembly 46 is movable between the operative position shown in FIG. 1 and the retracted position shown in FIG. 4 by a control arm 47 which is pivotally connected to walls 20 and 49 and which is connected to an actuator rod 51 which is pivotally connected at 53 to an upstanding arm 55.

The three position valve enables back-wash of the filter 121 when the valve is in the FIG. 5 position.

We claim:

1. In a floor treating applicator having a frame, wheels for supporting the frame for movement on a working surface and a liquid applicator pad assembly, the improvement wherein said pad assembly includes means for pivotally mounting said pad assembly on said frame for movement between a floor-engaging operative position and a retracted unoperative position, and a drip pan associated with said applicator pad so that it is downwardly open and facing the work surface when the pad is in an operative floor-engaging position and is movable with said pad when said pad is retracted and located beneath the pad and upwardly open to catch the working fluid dripping from the lower edge of the pad when the pad and drip pan are in the retracted position and including a wax applicator tube contained within said drip pan, with orifices located to disperse and apply the working fluid in advance of the pad as the applicator is moved during the course of application of the working fluid.

2. In a fluid applicator for floors having a frame and a fluid dispensing member and having a ground-engaging drive wheel to support a frame and a reservoir of working fluid, the improvement including a pump and a fluid circuit connecting said reservoir to a fluid applicator pipe, and wherein said pump has a piston, and drive means connecting said drive wheel to said pump to drive said pump, and said drive means including means to change the stroke of said piston to vary the amount of fluid ejected from the applicator tube and wherein said drive means includes one-way clutch means to afford pump operation only when said applicator is moved in a selected direction.

3. In a fluid applicator for floors having a frame and a fluid dispensing member and having a ground-engaging drive wheel to support a frame and a reservoir of working fluid, the improvement including a pump and a fluid circuit connecting said reservoir to a fluid applicator pipe, and wherein said pump has a piston, and drive means connecting said drive wheel to said pump to drive said pump, and said drive means including means to change the stroke of said piston to vary the amount of fluid ejected from the applicator tube and in which said drive means includes a first link with an eccentric drive connection to said drive wheel, a second link connected to said first link, adjustable pivot means adjustable through a range of positions pivotally connecting said second link to said frame, said pump having a piston rod and means connecting said second link to said pump so that said adjustable pivot means can be adjusted to a selected position to change the piston stroke to provide a desired pumping output.

4. The fluid applicator of claim 3 including an adjustment arm connected to said adjustable pivot means, and detent means associated with said arm to lock said arm in any one of a plurality of selected pumping capacity positions.

5. In a fluid applicator for floors having a frame and a fluid dispensing member and having a ground-engaging drive wheel to support a frame and a reservoir of working fluid, the improvement including a pump and a fluid circuit connecting said reservoir to a fluid applicator pipe, and wherein said pump has a piston, and drive means connecting said drive wheel to said pump to drive said pump, and said drive means including means to change the stroke of said piston to vary the amount of fluid ejected from the applicator tube and wherein said fluid circuit includes a three-position valve conduit connecting said reservoir to said pump to both sides of said pump piston, conduits connecting the pump to said three-way valves and one-way valves in said circuit to alternately afford communication of treatment fluid from said reservoir to both sides of said pump and from both sides of said pump to said valve, and a conduit connecting said three-way valve to said fluid applicator and in one position said three-way valve returning the pumping output to said reservoir, in a second position delivering the pumping output to said applicator, and in a third position closing said circuit.

6. In a floor treating applicator having a frame, wheels for supporting the frame for movement on a working surface and a liquid applicator pad assembly, the improvement wherein said pad assembly includes means for pivotally mounting said pad assembly on said frame for movement between a floor-engaging operative position and a retracted unoperative position, and a drip pan associated with said applicator pad so that it is downwardly open and facing the work surface when the pad is in an operative floor-engaging position and is movable with said pad when said pad is retracted and located beneath the pad and upwardly open to catch the working fluid dripping from the lower edge of the pad when the pad and drip pan are in the retracted position and in which said applicator assembly includes a pad mounting plate, said means for pivotally mounting said pad assembly to said frame includes upstanding ears on said mounting plate arms extending from said drip pan, with slots in said arms and at least one spring-loaded pin on one of said ears engageable with one of said arm slots to enable quick release of said mounting plate and afford independent vertical motion of each end of said pad with respect to said arms.

7. In a fluid applicator for floors having a frame and a fluid dispensing member having a ground-engaging drive wheel to support a frame and a reservoir of working fluid, the improvement comprising a variable displacement pump and a fluid circuit connecting the reservoir to a fluid applicator pipe, an axle for said drive wheel and eccentric means connecting said drive wheel to said pump, said eccentric means including a circular disc fixed on said axle in non-concentric relationship to said axle and a ring arranged around said disc and means connecting said disc to said pump and including means to change the throw of said drive means to vary the displacement of the pump to change the flow from the applicator tube to a selected volume.

* * * * *